United States Patent [19]

Heinz et al.

[11] 3,951,304

[45] Apr. 20, 1976

[54] APPARATUS FOR TRANSPORTING SMALL OBJECTS

[75] Inventors: Dieter Heinz, Heideck; Manfred Sittmann, Stuttgart, both of Germany

[73] Assignee: ABG Apparatebau Gesellschaft mbH, Schweigern, Germany

[22] Filed: June 10, 1974

[21] Appl. No.: 478,094

Related U.S. Application Data

[63] Continuation of Ser. No. 301,676, Oct. 27, 1972, abandoned.

[30] Foreign Application Priority Data

Oct. 28, 1971 Germany ..... 2153733
Mar. 11, 1972 Germany ..... 2211897

[52] U.S. Cl. ..... 221/124; 198/137; 198/165; 221/165

[51] Int. Cl.[2] ..... B65H 3/44

[58] Field of Search ..... 198/34, 220 BC, 220 A, 198/250, 273, 26, 37, 40, 137, 165, 202, 287; 221/164, 165, 12, 13, 124, 129

[56] References Cited

UNITED STATES PATENTS

| | | | |
|---|---|---|---|
| 2,854,730 | 10/1958 | Ingham | 221/165 |
| 3,133,670 | 5/1964 | Heyer | 198/220 BC |
| 3,162,874 | 12/1964 | Autio | 198/250 |
| 3,556,342 | 1/1971 | Guarr | 221/124 |
| 3,578,142 | 5/1971 | Burgess | 198/220 BC |
| 3,610,464 | 10/1971 | Loughry | 221/13 |

*Primary Examiner*—John J. Love
*Assistant Examiner*—Joseph E. Valenza
*Attorney, Agent, or Firm*—Michael J. Striker

[57] ABSTRACT

A pot-shaped vibratory conveyor discharges small objects along a circular path successively into an outlet which is directly connected with the inlet of a gap between two parallel confronting belt portions extending tangentially to the circular path so that the objects are singly transported by the belt portions, and can be counted by a photoelectric sensor before being collected in a container from which they are discharged when a predetermined number of objects is collected. The containers of several units can be simultaneously opened to discharge the objects into the same bag when the containers of different units contain selected numbers of different objects.

11 Claims, 6 Drawing Figures

APPARATUS FOR TRANSPORTING SMALL OBJECTS

CROSS-REFERENCE TO RELATED APPLICATION

The present application is a continuation application of the copending application Ser. No. 301,676, filed Oct. 27, 1972 and now abandoned.

BACKGROUND OF THE INVENTION

The present invention relates to an apparatus for counting small objects, such as screws, and for filling the objects into bags. Apparatus of this type is known which has a circular pot-shaped vibratory conveyor which conveys the object piece-by-piece to a transporting device which operates at a high speed to further separate the transported object. It is also known to provide a photoelectric sensor which cooperates with an electric control and counting device which counts up to a predetermined number of pulses produced by the photocell, and thereby counts the number of objects. The vibratory conveyor and the transporting means are controlled by the control and counting device.

In a known apparatus of this type, a tangential outlet channel is connected with the vibratory conveyor, through which small objects are piled up on a transporting band. Since the objects can move in the outlet channel or chute only at a limited speed, the output is comparatively low. The small objects can freely move on a transporting band and approach each other, so that the desired separation of the objects for the purpose of reliably counting the objects, cannot be obtained. At great transporting speed, there is the possibility that the separation by gravity is insufficient.

It is one object of the invention to provide an apparatus which transports small objects at a high speed, while reliably separating the transported objects.

Another object of the invention is to provide an apparatus capable of supplying different counted objects to a receptacle.

With these objects in view, the present invention provides that the output of a pot-shaped vibratory conveyor is at least substantially located on the circular path of the pot-shaped conveyor, and is directly followed by transporting means operating in tangential direction. A container, which can be closed and opened for discharge, follows the transporting means, and receives the transported objects successively. Due to the direct connection of a transporting means with the vibratory conveyor, the maximum speed can be utilized at which the vibratory container can supply the separated objects.

The collection, first in a container, permits the combination of several units, each of which includes a vibratory conveyor, a transporting means, a container for the transported objects, and a chute, so that the outlets of the chutes can be combined, permitting assorted different small objects to be placed in counted numbers. in a bag at a filling station.

The closures for the containers, which are preferably electro-mechanically operated, can be controlled by a control device, and permit discharge from the containers into the chutes only when all containers have collected the respective selected number of objects.

The operation can be fully automatically carried out, if the units are part of a filling arrangement in which bags or the like are automatically supplied to a filling station, filled with the objects for the apparatus of the invention, and then removed in filled condition.

In order to assure that small objects are singly transported to the outlet of the vibratory conveyor, and to the inlet of the transporting means, the spiral guide ramp of the pot-shaped vibratory conveyor tapers toward the outlet, and a track is provided thereon which may be a slot in which screws can be suspended with the heads sliding on parallel track portions forming a slot for the screws.

In one embodiment of the invention, the transporting means include two endless belts having confronting parallel belt portions forming between each other a gap of constant width. The confronting belt portion hold the objects immovably while transporting the same toward the outlet so that the objects cannot be displaced while being transported by the endless belts.

If the small objects are conical, for example wood screws, there is the danger that the conical objects are pushed out in vertical upward direction from the slot between the endless belts, so that the objects would not pass a photoelectric sensor in this region, and consequently would not be counted. In order to avoid such disadvantage, the invention provides above the gap formed by the confronting belt portions, a guide means on which the tops of the objects slide while being transported, so that the objects are retained in the slot, and are reliably counted.

It is an important feature of the invention that a photoelectric sensing means is arranged in the region of the transporting means, preferably underneath the endless belts. The light beam of the photoelectric sensor is interrupted by each object while the same is transported by the confronting belt portions. Due to the firm hold of the objects by the transporting belts, the separation of successive objects is reliably achieved, and the speed at which the objects are transported through the light beam, can be substantially higher than the speed obtained by free fall, as in the prior art.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
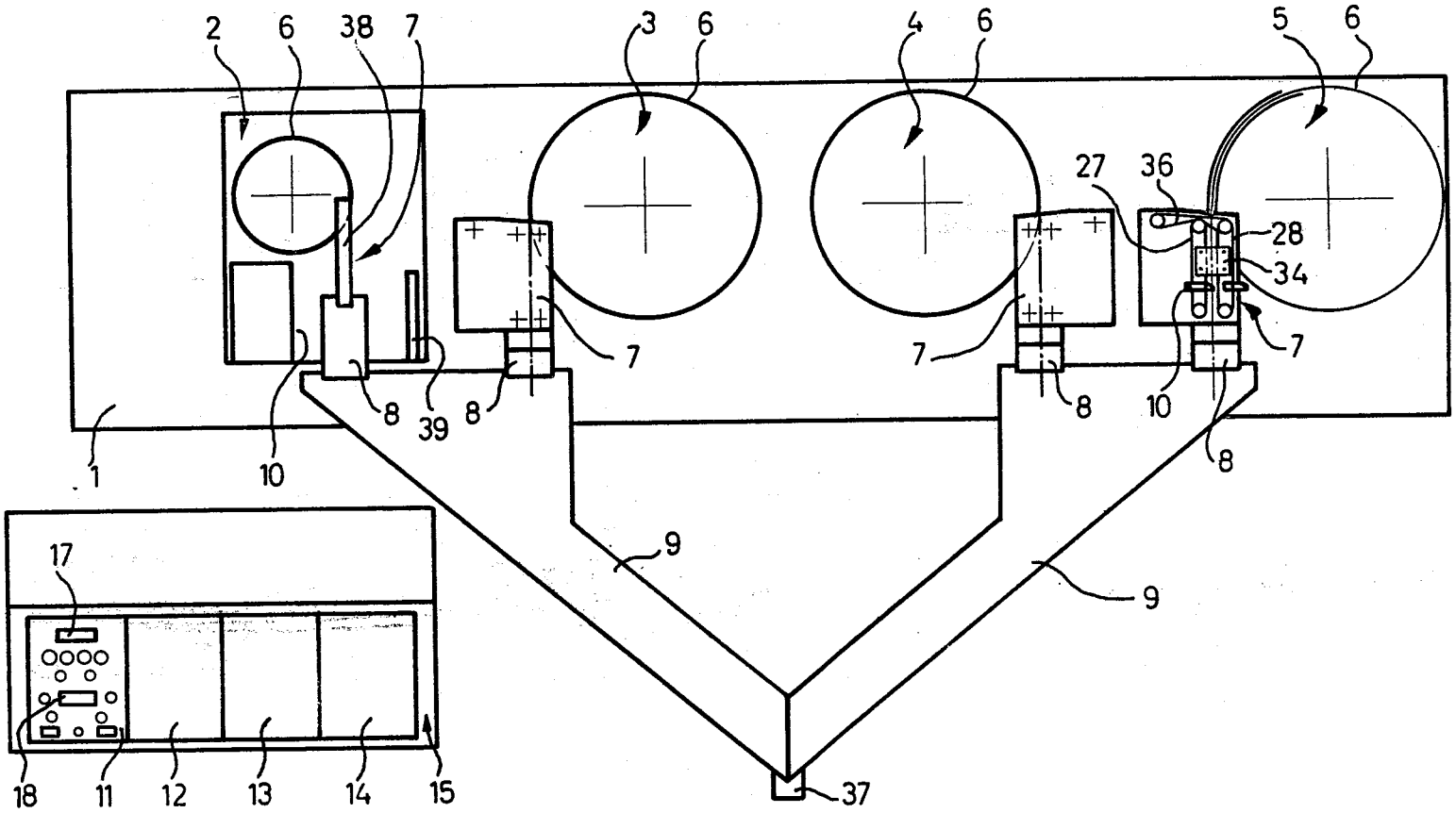
FIG. 1 is a schematic plan view illustrating a plurality of transporting units according to the invention combined for use at a single filling station.

Referring to FIG. 1, on a supporting base 1, four units 2 to 5 are mounted, each of which includes a pot-shaped vibratory conveyor 6, elongated transporting means 7, a container 8, and a chute 9 with a photoelectric sensor 10. The four units 2 to 5 are connected with corresponding units 11 to 14 of a control device 15 which has for each unit 11 to 14, counter means for counting the signals generated by the photoelectric sensing means 10 when the light beam thereof is broken by an object. Each of the control units 11 to 14 are connected with the respective transporting units 2 to 5 so as to connect and disconnect the vibratory conveyor 6, and to influence the transporting speed thereof. The number of objects to be counted by the photoelectric sensing means 10, is preselected and set in the control device 15 which, if desired, also operates a closure 16 of a receiving container 8 for permitting objects in the container 8 to be discharged through one of the chutes 9 to a bag or the like at a filling station 37.

A panel 17 of the control device 15, is provided with indicators showing the numbers of objects transported by the four transporting units 2, 3, 4, 5, and a panel 18 has an indicator for indicating the total number of all objects transported by the four transporting units 2 to 5 into the respective containers 8.

Figure 3:
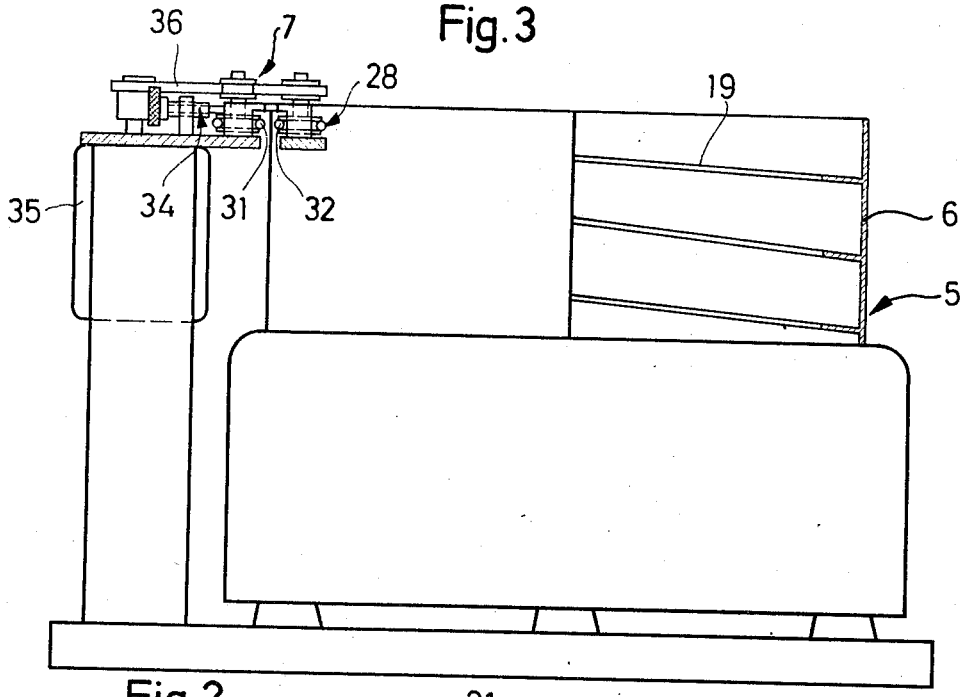
FIG. 3 is partially a side elevation, and partially a section taken on line III—III in FIG. 2.
Figure 2:
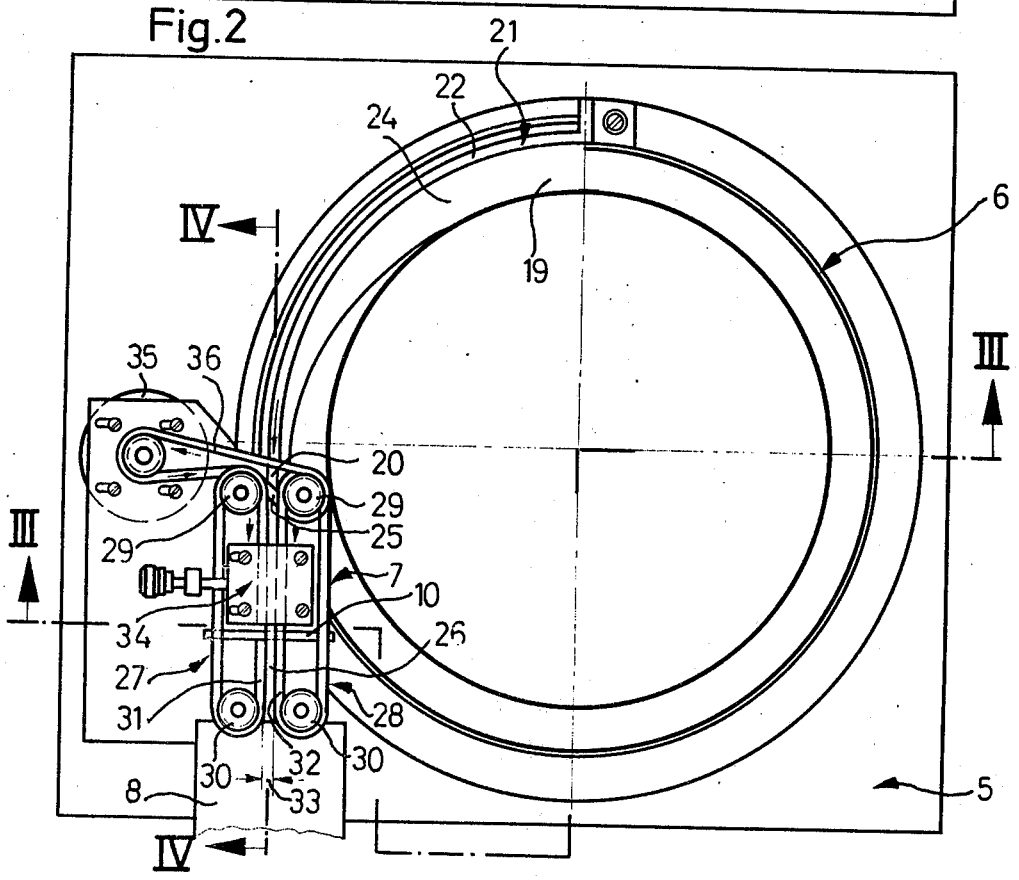
FIG. 2 is a plan view on an enlarged scale, showing one unit in accordance with a first embodiment of the invention.
Figure 4:
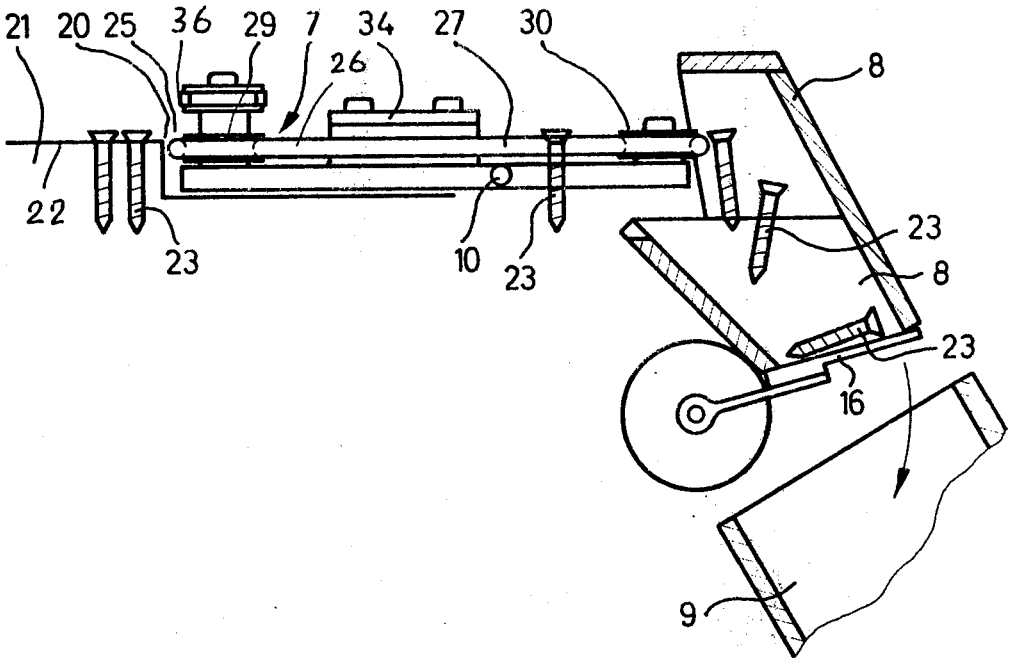
FIG. 4 is a fragmentary sectional view on a further enlarged scale, and taken on line IV—IV in FIG. 2.

FIGS. 2, 3 and 4 illustrate details of unit 5 of the apparatus of FIG. 1. The vibratory conveyor 6 is shown to be pot-shaped, and has an inner circular surface provided with spiral guide ramp whose upper end is tapered toward the outlet 20 and transports small objects, filled into the pot-shaped vibratory conveyor, to a track 21 which includes two parallel track portions or rails forming between each other a slot 22. When the small objects are screws 23, the threaded stems are located in the slot 22, while the heads are guided on the two track portions on opposite sides of slot 22, so that the screws 23 follow each other in a substantially vertical position while moving toward the outlet 20 whose width corresponds to the width of a single object.

The outlet 20 for the small objects 23 is directly adjacent the circular path 24 of the pot-shaped vibratory conveyor 6.

An elongated transporting means 7, for example a pair of endless belts 27, 28, has an inlet 25, and transports the objects in the gap 26 in a direction tangetial to the circular path 24 of the pot-shaped vibratory conveyor 6. Consequently, the small objects moving on the track 21 to the outlet 20, are directly received by the inlet 25 and transported in the gap 26 between the pair of transporting belts 27, 28.

The endless belts 27, 28 preferably consist of an elastic material, and are shown to be provided only in the units 3, 4 and 5. Each endless belt 27, 28 is guided about a drive roller 29 and a guide roller 30, and the confronting belt portions 31, 32 are parallel and form a gap 26 having a constant width 33 along the length thereof, corresponding to the width of the transported objects, and being adjustable by an adjusting device 34 to the shape of the objects which are to be transported.

The drive rollers 29 are driven by a motor 35 through a belt 36 at a level located above the transporting gap 26 so that the confronting belt portions 31, 32 are moved parallel to each other in the same direction, as best seen in FIGS. 2 and 3.

Photoelectric sensing means 10 are arranged in the region of the transporting means 7, and located in the embodiment of FIG. 2 under the endless belts 27, 28, having a light beam across the gap 26, and being electrically connected, not shown, with the counting unit of the control device 15 so that interruptions of the beam by small transported objects cause signals which are counted by the counter unit 14.

Figure 5:
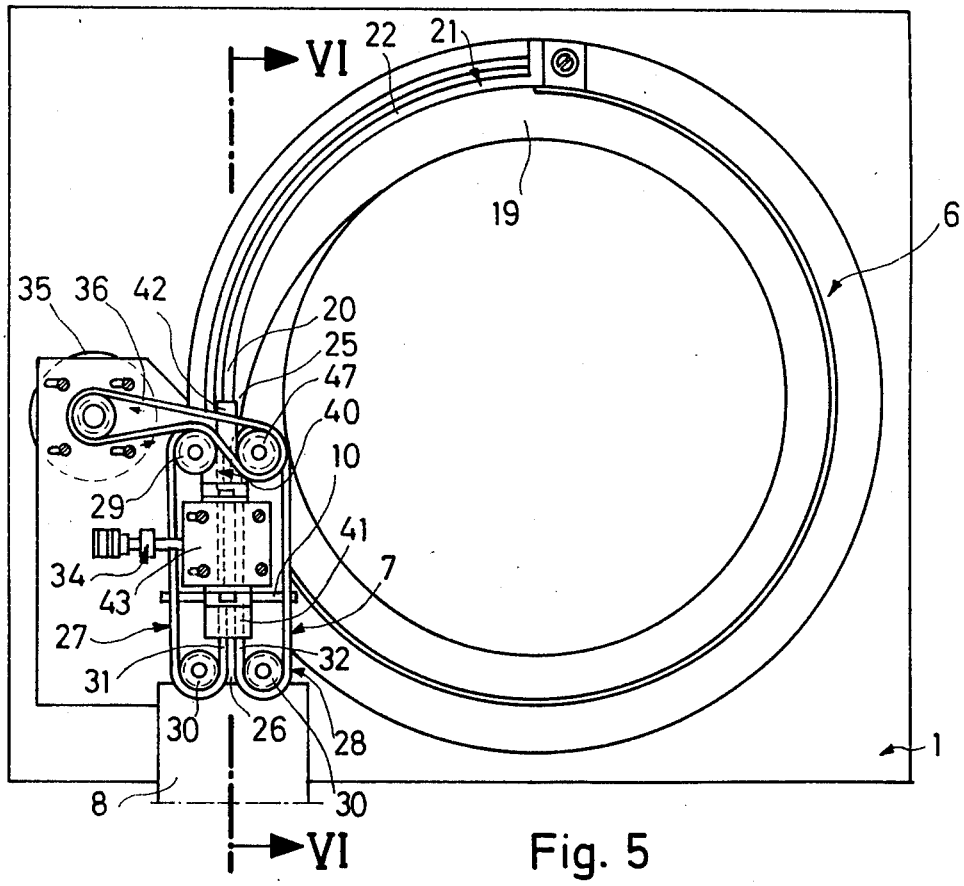
FIG. 5 is a plan view corresponding to FIG. 2, and illustrating a modified embodiment of the invention.
Figure 6:
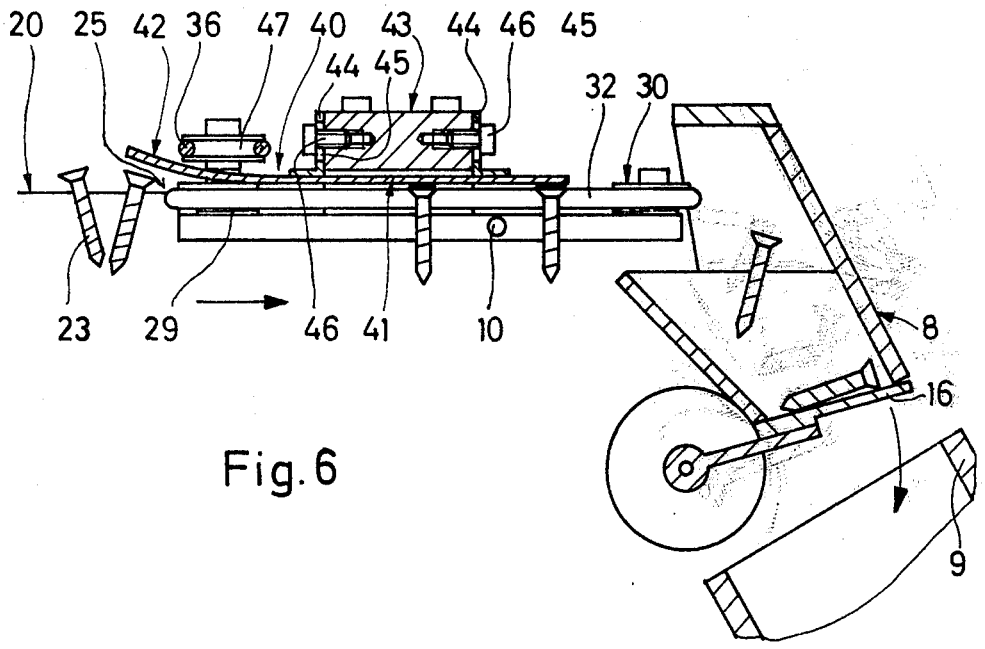
FIG. 6 is a sectional view on an enlarged scale taken on line VI—VI in FIG. 5.

In the modified embodiment shown in FIGS. 5 and 6, the gap between the portions 31, 32 of the endless belts 27, 28 is covered on top by a guide means, shown to be a strip 40 above the gap 26, consisting of a sheet material. The guide means 40 has a straight guide portion 41, and a bent up inlet portion 42, and preferably consist of a metal sheet material. The guide means 40 is supported on a support 43 which bridges the belts 27, 28 and gap 26. As best seen in FIG. 6, the guide strip 40 has brackets 44 attached thereto whose vertical portions are provided with slots 45 through which screws 46 are screwed into threaded bores of the bridge-shaped support 43. The inlet portion 42 of guide strip 40 is located between one of the drive rollers 29, and the roller 47 which guides the drive belt 36. Roller 47 has a common axis with one of the drive rollers 29, while the other drive roller 29 and roller 47 are located on opposite sides of the gap 26.

Small objects 23, which are transported by the pair of endless belts 27, 28 from the inlet 25 to the other end of gap 26, are supplied into a container 8, a corresponding container being also provided for the transporting unit 2. Each container 8 has a bottom closure 16, for example a flap operated by an electromagnet, so that the container 8 is opened by electric operation of the closure 16 for discharge into a chute 9, and can then be closed under the control of the control device 15 in a conventional manner. When the flap closures 16 are opened, objects accumulated in the respective container 8, fall into a chute 9 common to two adjacent transporting units 2 and 3, or 4 and 5.

The transporting unit 2 is different from the other transporting units 3, 4 and 5 inasmuch that the transporting device 7 includes a narrow vibratory trough 38, whose width corresponds to the width of the transported objects 23, and whose inlet is directly connected with the outlet 20. The vibratory trough 38 discharges the objects at the other end thereof into the respective container 8. While moving along the vibratory trough 48, the objects pass the beam of the photoelectric sensing means 10 which is advantageously constructed as a light barrier with a reflector 39. In this manner, signals indicating the number of objects discharged into container 8 are transmitted to the counter unit 11, and counted until a number preset in the control device 15 is reached, whereupon the control device 15 operates the respective closure 16 of the container 8 for discharge into the chute 9. A signal may also be given to stop the vibratory conveyor 6 and the vibratory trough 38.

The vibratory trough 38 may be used as a transporting means 7 instead of the belts 27, 28, if the objects transported by the transporting unit 9 are more suitable for transport by a vibratory trough than by a pair of belts, which are particularly suited for screws.

During operation, small objects, particularly screws 23 are thrown into the pot-shaped vibratory conveyors 6. For each of the transporting units 2 to 5, the counting units 11 to 14, respectively, are set to the number of objects which are to be collected in each container 8.

When the vibratory conveyor 6 starts the operation, the small objects rise along the spiral guide ramps 19, and are separately transported to the outputs 20.

In the transporting units 3, 4 and 5, the pair of belts 27, 26 grips the objects 23 and transport the same in the gap 26 at a substantially higher speed than the transporting speed of the vibratory conveyor 6. While moving in tangential direction in the gap 26, the objects pass successively the photoelectric sensing means, and the respectively generated signals are registered by the counter units 12, 13 and 14. In accordance with the number of counted signals and objects, the control device 15 is preset to reduce the speed of the vibratory conveyor 6 before desired number of objects has been collected in the respective container 8, so that the last objects are transported at a lower transporting sheet.

When the desired number, preset in the control device 15, is reached, the respective vibratory conveyor 6 is disconnected from the voltage by the respective counter units 11 to 14. When in each container 8 the desired number of objects has been collected, the closure flaps 16 can be manually or automatically opened so that the objects in the containers 8 associated with the transporting units 4 and 5 fall into a first chute 9, while the objects accumulated in the containers 8 of the transporting units 2 and 3 fall into the other chute 9, both chutes 9 opening into a bag, not shown, at a filling station 37.

It is assumed that objects different from the screws 23 are transported by the transporting unit 2, and that therefore the vibratory chute 38 was used. Such different objects are also counted by the counter 11, and a predetermined number of different objects is filled into the bag at the filling station 37 together with the screws 23 transported and discharged by the three transporting units 3, 4 and 5.

By supplying different objects also to the pot-shaped vibratory conveyors 6 of the transporting units 3, 4 and 5, four different numbers of different groups can be combined and the bags filled with the respective assortment.

The apparatus of the invention assures the exact counting of small objects at a very high transporting speed, and can be operated to automatically fill assortments of different objects in bags at a filling station.

It is possible to automatically supply the bags at the filling station 37, and to automatically close the bags after the bags have been filled by the assortment of objects transported by the transporting units 2, 3, 4 and 5, whereupon the filled closed bags are removed. This operation is synchronized in a conventional manner with the opening of the closures 16 of the containers 8 under the control of control device 16.

It will be understood that each of the elements described above, or two or more together, may also find a useful application in other types of apparatus for transporting objects differing from the types described above.

While the invention has been illustrated and described as embodied in an apparatus for transporting small units in which the outlet of a pot-shaped vibratory conveyor 6 is directly connected with tangentially extending transporting means, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

We claim:

1. Apparatus for supplying a predetermined number of small objects, each of which has a head portion and a stem portion of predetermined diameter, said apparatus including at least one unit comprising pot-shaped vibratory conveyor means adapted to receive a great number of said small objects, said pot-shaped vibratory conveyor means having a substantially circular path including a pair of parallel track portions forming between each other a slot adapted to receive the stem portions of said objects while said head portions slide on said track portions, and an outlet through which said objects are discharged seriatim and at a predetermined speed; elongated transporting means extending tangential to said substsantially circular path and having an inlet at said outlet end of said pot-shaped conveyor means for receiving objects discharged through said outlet of said pot-shaped conveyor means, said elongated transporting means comprising a pair of driven endless belts located in a common horizontal plane and having confronting belt portions located in parallel vertical planes and forming between each other a gap open in a vertical plane and having a constant width corresponding to the stem diameter of the objects so that the stem portions are firmly gripped by said confronting belt portions with free ends of said stem portions projecting downwardly beyond said belts, means for moving said confronting belt portions in the same direction and at a speed greater than the predetermined speed so that said objects are transported spaced from each other from said inlet to the opposite end of said elongated transporting means, a stationary support bridging said belt portions above said gap, and elongated guide means mounted on said support below the latter and above said gap for slidingly guiding the heads of objects transported in said gap by said confronting belt portions; sensing means arranged adjacent said belts for cooperation with said projecting ends of said stem portions for creating a signal during passing of each of the spaced stem portions past said sensing means; counter means receiving said signals from said sensing means and counting the number of objects passing said sensing means; receiving means adjacent said opposite end of said elongated transporting means for receiving the counted objects; and control means cooperating with said counter means for stopping operation of said conveyor and transporting means and for discharging the objects from said receiving means after a predetermined number of objects has been received therein.

2. Apparatus as claimed in claim 1 wherein said transporting means includes adjusting means for adjusting the position of at least one of said belt portions for varying the constant width of said gap in accordance with the shape of said stems.

3. Apparatus as claimed in claim 1 wherein said endless belts consist of an elastic material.

4. Apparatus as claimed in claim 1 wherein said guide means includes an inlet portion approaching said gap, and a guide portion closing the upper end of said gap.

5. Apparatus as claimed in claim 4 wherein said guide means is an elongated strip of a sheet material, and wherein said inlet portion is bent away from said guide portion.

6. Apparatus as claimed in claim 1 wherein said transporting means include adjusting means for vertically adjusting said guide means.

7. Apparatus as claimed in claim 1 wherein said guide means includes a strip of a sheet material having vertical projections abutting said support and having slots, and screws securing said projections to said support and passing through said slots so that the position of said strip of sheet material can be adjusted.

8. Apparatus as claimed in claim 1, wherein said sensing means comprise photoelectric sensing means.

9. Apparatus as claimed in claim 1, wherein said receiving means comprises a container having a lower open end and closure means movable between an open and a closed position closing said open end and being normally held in said closed position, said control means cooperating with said closure means for moving the latter to said open position after a predetermined number of objects has been received by said container.

10. Apparatus as claimed in claim 1, wherein said apparatus comprises a plurality of said units, and wherein said receiving means of each unit comprises a container having a lower open end and closure means movable between a normally closed and an open position and being moved by said control means to said open position after a predetermined number of objects has been received by the respective container, and further including at least one chute for receiving the objects discharged from said containers and for delivering the objects to a filling station.

11. Apparatus as claimed in claim 10, wherein said plurality of units comprises a plurality of pairs of adjacent units, wherein each unit of each pair of units has a delivery chute, and wherein said delivery chutes meet at a filling station.

* * * * *